US007025838B2

(12) United States Patent
Yazawa et al.

(10) Patent No.: US 7,025,838 B2
(45) Date of Patent: Apr. 11, 2006

(54) FERRITIC STAINLESS STEEL SHEET WITH EXCELLENT WORKABILITY AND METHOD FOR MAKING THE SAME

(75) Inventors: Yoshihiro Yazawa, Chiba (JP); Osamu Furukimi, Chiba (JP); Mineo Muraki, Chiba (JP); Yoshihiro Ozaki, Chiba (JP); Kunio Fukuda, Chiba (JP); Yukihiro Baba, Chiba (JP)

(73) Assignee: JFE Steel Corporation, (JP)

( * ) Notice: Subject to any disclaimer, the term of this patent is extended or adjusted under 35 U.S.C. 154(b) by 0 days.

(21) Appl. No.: 10/779,897

(22) Filed: Feb. 17, 2004

(65) Prior Publication Data

US 2004/0159380 A1 Aug. 19, 2004

Related U.S. Application Data

(62) Division of application No. 10/047,900, filed on Jan. 14, 2002, now Pat. No. 6,733,601.

(30) Foreign Application Priority Data

Jan. 18, 2001 (JP) ..... 2001-009920

(51) Int. Cl.
*C21D 8/04* (2006.01)

(52) U.S. Cl. ..... 148/610; 148/651; 148/537

(58) Field of Classification Search ..... 148/651, 148/610, 537

See application file for complete search history.

(56) References Cited

U.S. PATENT DOCUMENTS 3,650,848 A * 3/1972 Schneider et al. ..... 148/610

(Continued)

FOREIGN PATENT DOCUMENTS

EP 0 435 003 A1 7/1991

(Continued)

OTHER PUBLICATIONS

Edited by R.W. Cahn, P. Haasen, E.J. Kramer, "Materials Science and Technoogy, vol. 7, Constitution and Properties of Steels", 1992, VCH, Weinheim XP-002196998, pp. 53-54, 82-83 & 305.

*Primary Examiner*—Deborah Yee
(74) *Attorney, Agent, or Firm*—DLA Piper Rudnick Gray Cary US LLP

(57) ABSTRACT

A ferritic stainless steel sheet for use in automobile fuel tanks and fuel pipes having smooth surface and resistance to organic acid is provided. The sheet contains, by mass, not more than about 0.1% C, not more than about 1.0 Si, not more than about 1.5% Mn, not more than about 0.06% P, not more than about 0.03% S, about 11% to about 23% Cr, not more than about 2.0% Ni, about 0.5% to about 3.0% Mo, not more than about 1.0% Al, not more than about 0.04% N, at least one of not more than about 0.8% Nb and not more than about 1.0% Ti, and the balance being Fe and unavoidable impurities, satisfying the relationship: $18 \leqq Nb/(C+N)+2Ti/(C+N) \leqq 60$, wherein C, N, Nb, and Ti in the relationship represent the C, N, Nb, and Ti contents by mass percent, respectively. A process for making the same is also provided.

18 Claims, 4 Drawing Sheets

U.S. PATENT DOCUMENTS

| | | | | |
|---|---|---|---|---|
| 3,713,812 | A * | 1/1973 | Brickner | 420/69 |
| 5,512,239 | A | 4/1996 | Fujiwara et al. | |
| 5,677,268 | A * | 10/1997 | Omosako et al. | 508/171 |
| 5,709,836 | A * | 1/1998 | Fujisawa et al. | 420/41 |
| 5,859,095 | A * | 1/1999 | Moyle et al. | 523/402 |
| 6,645,318 | B1 * | 11/2003 | Takahashi et al. | 148/325 |

FOREIGN PATENT DOCUMENTS

| | | |
|---|---|---|
| EP | 0 675 206 A1 | 10/1995 |
| EP | 0 765 941 A1 | 4/1997 |
| EP | 1 113 084 A1 | 7/2001 |
| JP | 58 199822 | 11/1983 |
| JP | 62 149385 | 7/1987 |
| JP | 08 291332 | 11/1996 |

* cited by examiner

FERRITIC STAINLESS STEEL SHEET WITH EXCELLENT WORKABILITY AND METHOD FOR MAKING THE SAME

This application is a Divisional of Ser. No. 10/047,900 filed Jan. 14, 2002, now U.S. Pat. No. 6,733,601 issued May 17, 2004.

BACKGROUND OF THE INVENTION

1. Field of the Invention

This invention relates to ferritic stainless steel sheets having excellent deep-drawability and surface smoothness applicable to home electric appliances, kitchen appliances, construction, and automobile components and to methods for making the same. In particular, the invention relates to a ferritic stainless steel sheet suitable for use in automobile fuel tanks and fuel pipes which are made by high deformation such as deep drawing and pipe expanding, and are highly resistant to organic fuels such as gasoline and methanol which contain organic acids produced in the ambient environment. A method for making the same is also provided.

2. Description of the Related Art

Ferritic stainless steels which do not contain large amounts of nickel (Ni) are cost effective compared with austenitic stainless steels and a-re free of stress corrosion cracking (SCC). Due to these advantages, ferritic stainless steels have been used in various industrial fields. However, known ferritic stainless steels exhibit low elongation of approximately 30% and are thereby inferior to austenitic stainless steels, for example, SUS 304, in workability. Known ferritic stainless steels do not have sufficient workability for high deformation such as deep drawing, and typically, press forming, and are not suitable for mass production. Because of these problems concerning formability, the use of ferritic stainless steel in various fields such as automobiles, construction, and home electric appliances has been severely limited.

Several attempts have been made to improve the formability of ferritic stainless steels. Among these, Japanese Unexamined Patent Publication No. 3-264652 proposes optimization of manufacturing conditions of ferritic stainless steels containing Nb and Ti in order to obtain an aggregation structure of 5 or more in X-ray intensity ratio (222)/(200) and to improve the formability.

In this technology, however, the revalue is only about 1.8; hence, application to fuel tanks requiring complex forming by deep drawing and to fuel pipes requiring pipe-expansion and bending is difficult. Moreover, even if applied at all, defect rates are high and mass production is not practical. On the other hand, ternesheets, i.e. soft steel sheets provided with plating containing lead, have been widely used as the material for automobile fuel tanks. However, regulations on the use of lead are becoming stricter from an environmental point of view and substitutes for the ternesheets have been developed. The substitutes developed have the following problems. Lead-free Al—Si based plating materials are unreliable in terms of weldability and long-term corrosion resistance and the application thereof is thus limited. Resinous materials have been applied to fuel tanks, but since these materials naturally allow minute amounts of fuel to permeate, the industrial use thereof is inevitably limited under fuel transpiration and recycling regulations. Use of austenitic stainless steels which can be used without lining have also been attempted. Although austenitic stainless steels are superior in formability and corrosion resistance to ferritic stainless steels, they are expensive for use in fuel tanks and may suffer from stress corrosion cracking (SCC). Thus, the use of austenitic stainless steels has not been practical.

In such a situation, enormous advantages such as improvement of the global environment can be achieved if these materials can be substituted by ferritic stainless steels which are recyclable.

Since the revalue of ternesheets is approximately 2.0 ferritic stainless steels must attain an r-value of 2.0 or more for them to replace the ternesheets. Ferritic stainless steels must also have long-term corrosion resistance to deteriorated gasoline containing organic acids such as formic acid and acetic acid which are formed in the ambient environment in order for the ferritic stainless steels to be applied to fuel components such as automobile fuels tanks and pipes. However, no investigation has specified suitable compositions for attaining these goals.

As previously described, the r-value of the known ferritic stainless steels is only approximately 2.0 at most, and application of ferritic stainless steels to pressed components requiring extensive deep drawing has not been achieved. Another problem with ferritic stainless steels is the generation of rough surfaces after pressing by deep drawing. Here, rough surfaces include the orange peel condition caused by rough crystal grains and the presence of corrugations aligned in the rolling direction (L direction) as a result of cold rolling thereby rendering undulating surfaces in the sheet width direction.

OBJECTS OF THE INVENTION

In view of the above, a first object of the invention is to provide a ferritic stainless steel exhibiting enhanced deep-drawability which is suitable for application to automobile fuel tanks and pipes by improving the r-value to 2.0 or more and provide a method for making the same.

In particular, an object of the invention is to provide a ferritic stainless steel exhibiting an average r-value as the parameter of deep-drawability of 2.0 or more, preferably about 2.2 more, having a crystal grain size number in the finished annealed sheet as the parameter of the surface-roughness of about 6.0 or more, and developing no red rust after corrosion resistance testing using deteriorated gasoline containing 800 ppm of formic acid at 50° C. for 5,000 hours.

The average r-value is defined as the average plastic strain ratio according to Japanese Industrial Standard (JIS) Z 2254 calculated using the equation below:

$$r=(r_0+2r_{45}+r_{90})/4$$

wherein, $r_0$ denotes a plastic strain ratio measured using a test piece sampled in parallel to the rolling direction of the sheet;

$r_{45}$ denotes a plastic strain ratio measured using a test piece sampled at 45° to the rolling direction of the sheet; and $r_{90}$ denotes a plastic strain ratio measured using a test piece which is sampled at 90° to the rolling direction of the sheet.

Another object of the invention is to solve the problems conventionally experienced during forming the ferritic stainless steel sheets into fuel tanks and pipes of severe shapes and during a process such as pressing which requires omission of application of vinyl lubricant or oil.

SUMMARY OF THE INVENTION

Based on our research, we found that application of a lubricant coat containing acrylic resin as the primary component on the surface of the steel sheet at an amount within a predetermined range improves the sliding property during press forming and reduce the dynamic friction coefficient between the ferrite stainless steel and pressing dies. Thus, "galling" can be prevented and products of further complicated shapes can be manufactured.

In order to attain the above-described objects, we conducted extensive research on improvement of the corrosion resistance with deteriorated gasoline, deep drawability, and surface roughness after processing required for applying ferritic stainless steels to automobile fuel components. We found that the corrosion resistance with deteriorated gasoline can be effectively improved by including about 0.5 mass percent (hereinafter, simply referred to as %) of Mo, controlling the sum Cr+3.3Mo (pitting index) to not less than about 18%, and inhibiting the rough surface after processing. We also found that the disadvantages of including large amounts of Mo, i.e., degradation in deep drawability and generation of rough surfaces, can be overcome by performing cold rolling at least twice with an intermediate annealing process therebetween and by optimizing the manufacturing conditions such as crystal grain sizes during cold rolling. Moreover, we found that the dynamic friction coefficient between ferritic stainless steel sheets and dies can be reduced by coating the steel sheet surface with a lubricant coat to improve sliding properties during forming. Thus, the ferritic stainless steel sheets can be formed into products having more complex shapes.

To achieve these objects, an aspect of the invention provides a ferritic stainless steel sheet having an average revalue of at least 2.0 and a ferrite crystal grain size number determined according to Japanese Industrial Standard (JIS) G 0552 of at least about 6.0, the ferritic stainless steel sheet comprising, by mass percent:

not more than about 0.1% C, not more than about 1.0% Si, not more than about 1.5% Mn, not more than about 0.06% P, not more than about 0.03% S, about 11% to about 23% Cr, not more than about 2.0% Ni, about 0.5% to about 3.0% Mo, not more than about 1.0% Al, not more than about 0.04% N, at least one of not more than about 0.8% Nb and not more than about 1.0% Ti, and the balance being Fe and unavoidable impurities, satisfying relationship (1):

$$18 \leqq Nb/(C+N)+2Ti/(C+N) \leqq 60 \quad (1)$$

wherein C, N, Nb, and Ti in relationship (1) represent the C, N, Nb, and Ti contents by mass percent, respectively.

The Cr and Mo contents may satisfy the relationship (2):

$$Cr+3.3Mo \geqq 18 \quad (2)$$

wherein Cr and Mo represent in relationship (2) represents the Cr and Mo contents by mass percent, respectively.

Preferably, the X-ray integral intensity ratio (222)/(200) at a plane parallel to the sheet surface is not less than about 15.0.

Preferably, the ferritic stainless steel sheet is bake-coated with a lubricant coat comprising an acrylic resin, calcium stearate, and polyethylene wax in a coating amount of about 0.5 to about 4.0 g/m$^2$.

Another aspect of the invention provides a method for making a ferritic stainless steel sheet, the method comprising the steps of:

preparing a steel slab containing not more than about 0.1% C, not more than about 1.0% Si, not more than about 1.5% Mn, not more than about 0.06% P, not more than about 0.03% S, about 11% to about 23% Cr, not more than about 2.0% Ni, about 0.5% to about 3.0% Mo, not more than about 1.0% Al, not more than about 0.04% N, at least one of not more than about 0.8% Nb and not more than about 1.0% Ti, and the balance being iron (Fe) and unavoidable impurities, satisfying relationship (1):

$$18 \leqq Nb/(C+N)+2Ti/(C+N) \leqq 60 \quad (1)$$

where C, N, Nb, and Ti in relationship (1) represent the C, N, Nb, and Ti contents by mass percent, respectively;

heating the steel slab at a temperature in the range of about 1,000° C. to about 1,200° C., hot-rough-rolling the steel slab at a rolling temperature of at least one pass of about 850° C. to about 1,100° C. by a reduction of about 35%/pass, hot-finish-rolling the slab at a rolling temperature of at least one pass of about 650° C. to about 900° C. by a reduction of about 20 to about 40%/pass to prepare a hot-rolled sheet;

annealing the hot-rolled sheet at a temperature in the range of about 800° C. to about 1,100° C.;

cold-rolling the resulting annealed sheet at least twice with intermediate annealing therebetween, said cold rolling being performed at a gross reduction of about 75% or more and a reduction ratio (reduction in the first cold rolling)/(reduction in the final cold rolling) in the range of about 0.7 to about 1.3; and finish annealing the cold-rolled sheet at a temperature in the range of about 850° C. to about 1,050° C.

Preferably, the Cr and Mo contents in the steel slab satisfy the relationship (2):

$$Cr+3.3Mo \geqq 18 \quad (2)$$

wherein Cr and Mo in relationship (2) represent Cr and Mo contents by mass percent, respectively.

Preferably, the grain size number of ferrite crystal grains of the steel sheet before the final cold rolling measured according to JIS G 0552 is not less than about 6.5.

Preferably, said step of cold rolling is performed in a single direction using a tandem rolling mill comprising a work roller having a diameter of about 300 mm or more.

The method for making the ferritic stainless steel sheet may futher comprise the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

DESCRIPTION OF PREFERRED EMBODIMENTS

Figure 1:
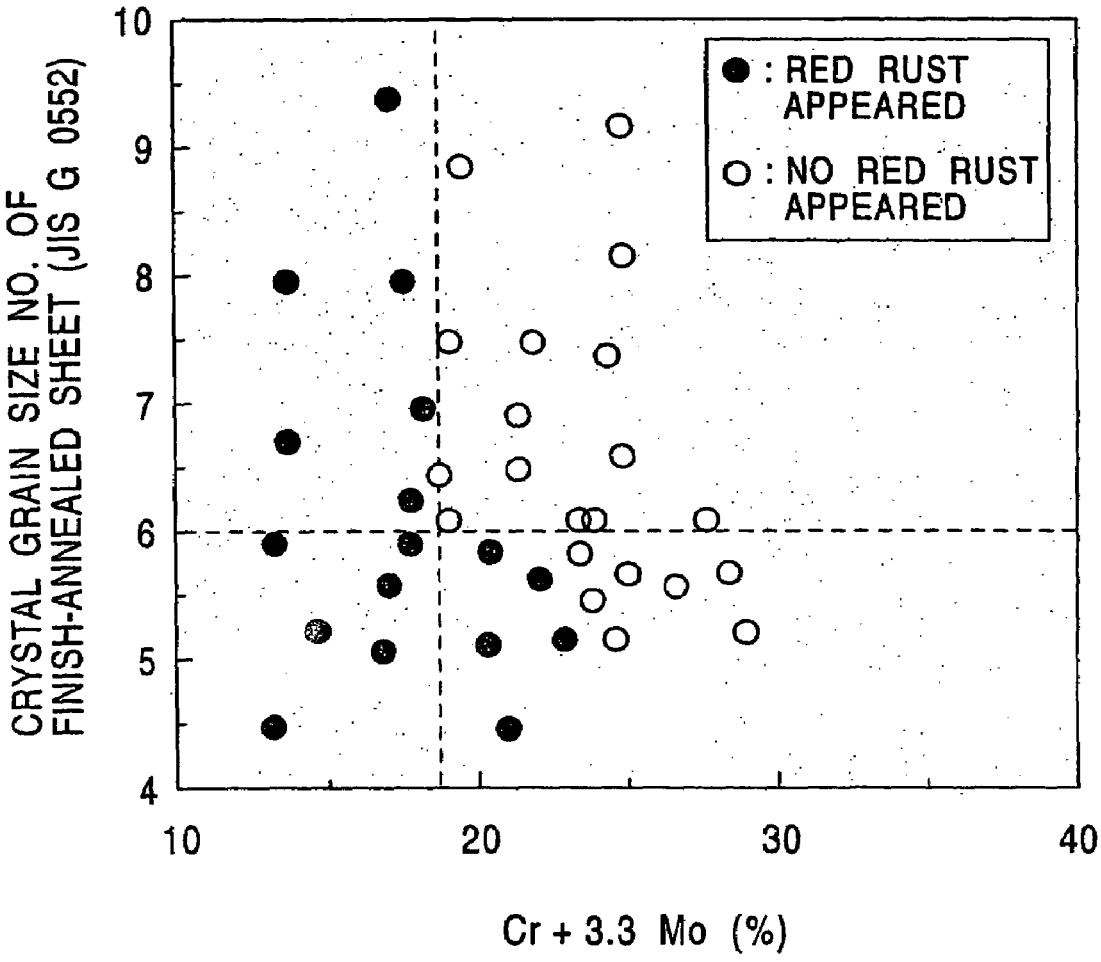
FIG. 1 is a graph showing the effect of a sum Cr+3.3Mo and grain size numbers of a finish-annealed sheet on corrosion resistance to deteriorated gasoline after forming.

The components of the composition of a ferritic stainless steel sheet of the invention are now described. The content of each element is in terms of mass percent which is represented merely by % below.

C: not more than about 0.1%

Solute and precipitated carbon deteriorates the formability of the steel. Moreover, carbon precipitates mainly at grain boundaries as carbides, thereby deteriorating the brittle resistance to secondary processing and corrosion resistance of the grain boundaries. The deterioration in formability and corrosion resistance is particularly remarkable at a C content exceeding about 0.1%. Thus, the C content is limited to not more than about 0.1%. On the other hand, excessive reduction in the amount of carbon will increase the refining cost. In view of the above and particularly of the brittle resistance to secondary forming, the C content is preferably more than about 0.002%, but not more than about 0.008%.

Si: not more than about 1.0%

Silicon (Si) effectively improves the oxidation and corrosion resistance of the steel and particularly enhances the corrosion resistance of the outer and inner surfaces of fuel tanks. In order to achieve these advantages, the silicon content is preferably not less than about 0.2%. A Si content exceeding about 1.0% causes embrittlement of the steel and deteriorates the brittle resistance to the secondary forming at welded portions. Thus, the Si content is preferably not more than about 1.0%, and more preferably, not more than about 0.75%.

Mn: not more than about 1.5%

Manganese (Mn) improves oxidation resistance if contained in an adequate amount. Excessive manganese deteriorates the toughness of the steel and the brittle resistance to the secondary forming at welded portions. Thus, the Mn content is limited to not more than about 1.5%, and more preferably, not more than about 1.30%.

P: not more than about 0.06%

Phosphorus (P) readily segregates at the grain boundaries and impairs grain-boundary strength if contained with boron (B). Thus, in view of improving the brittle resistance to the secondary forming and high-temperature fatigue characteristics of welded parts, the P content is preferably as low as possible. However, because excessive reduction in the P content results in increased refining cost, the P content is limited to not more than about 0.06%, and more preferably, not more than about 0.03%.

S: not more than about 0.03%

The sulfur (S) content is preferably as low as possible since sulfur deteriorates the corrosion resistance of the stainless steel. Considering the cost required for desulfurization during refining, the S content is limited to not more than about 0.03%. Preferably, the S content is not more than about 0.01% since S can be fixed by Mn and Ti in such a case.

Cr: about 11% to about 23%

Chromium (Cr) improves the resistance to oxidation and corrosion. In order to achieve sufficient oxidation and corrosion resistance, the Cr content is preferably not less than about 11%. In view of the corrosion resistance of the welded portion, the Cr content is preferably not less than about 14%. On the other hand, chromium deteriorates the workability of the steel and this dis-advantage becomes particularly noticeable at a Cr content exceeding about 23%. Thus, the upper limit of the Cr content is about 23%. More preferably, the Cr content is between about 14% and about 18%.

Ni: not more than about 2.0%

Nickel (Ni) improves the corrosion resistance of the stainless steel and may be included at about 2.0% or less. At a Ni content exceeding about 2.0%, the steel hardens and may suffer from stress corrosion cracking due to the generation of the austenite phase. Thus, the Ni content is limited to not more than about 2.0%. More preferably, the Ni content is between about 0.2% and about 0.8%.

Mo: about 0.5% to about 3.0%

Molybdenum (Mo) improves the corrosion resistance to deteriorated gasoline. A Mo content of about 0.5% or more is required to achieve the improvement in the corrosion resistance to deteriorated gasoline, but a Mo content exceeding about 3.0% causes degradation in the workability as a result of precipitation during heat treatment. Thus, the Mo content is preferably in the range of about 0.5% to about 3.0%, and more preferably, about 0.7% to about 1.6%.

Cr+3.3Mo: not less than about 18

The sum of Cr+3.3Mo, wherein Cr and Mo are the contents by mass percent of the corresponding elements, indicates the corrosion resistance of stainless steels (pitting index). We found through research that the ferritic stainless steels for use with deteriorated gasoline should contain the above-described amount of Mo and should have the sum of Cr+3.3Mo of not less than about 18 in view of corrosion resistance to deteriorated gasoline, corrosion resistance of the outer surfaces, and corrosion resistance of the welded portions. A sum of Cr+3.3Mo exceeding about 30 causes hardening of the steel sheets and thereby deteriorates the workability of the steel sheets. In view of the above, the sum of Cr+3.3Mo is preferably not more than about 30, and more preferably, in the range between about 20 and about 25.

Since the corrosion resistance is closely related to the surface roughness after forming as described below, the finished annealed sheet is also required to satisfy the condition of about 6.0 or more in crystal grain size number.

FIG. 1 shows the results of testing on the corrosion resistance to deteriorated gasoline. Here, ferritic stainless steels having different Cr+3.3Mo and different crystal grain size numbers of the finished annealed sheets were tested to determine the corrosion resistance to deteriorated gasoline containing 800 ppm of formic acid at a testing temperature of 50° C. for a testing time of 25 hours x 200 cycles (a total of 5,000 hours). Each test piece was prepared by drawing a 0.8-mm-thick finished annealed sheet into a cylinder having a diameter of 80 mm and a height of 45 mm. One cycle included placing deteriorated gasoline in the cylindrical test piece, maintaining the test piece containing deteriorated gasoline at a predetermined temperature for 25 hours, and adding deteriorated gasoline to compensate for the amount of evaporated gasoline. After 200 cycles, the appearance of the test pieces was observed. The corrosion resistance to deteriorated gasoline was assessed based on the presence of red rust. As shown in FIG. 1, the test pieces of about 18% or more in Cr+3.3MO and about 6.0 or more in the grain number of the finished annealed sheet determined based on the cutting method described in Japanese Industrial Standard (JIS) G 0552 have satisfactory corrosion resistance to deteriorated gasoline.

Al: not more than about 1.0%

Although aluminum (Al) is an essential element in the steel making as a deoxidizer, an excess amount of aluminum deteriorates the surface appearance and the corrosion resistance due to formation of inclusions. Thus, the Al content is preferably not more than about 1.0%, and more preferably, not more than about 0.50%.

N: not more than about 0.04%

Nitrogen (N) at a suitable content strengthens the grain boundaries and improves the toughness but precipitates in the grain boundaries as nitrides at a content exceeding about 0.04%, thereby adversely affecting the corrosion resistance. Thus, the N content is preferably not more than about 0.04%, and more preferably, not more than about 0.020%.

Nb: not more than about 0.8%;

Ti: not more than 1.0%; and $$18 \leqq Nb/(C+N)+2Ti/(C+N) \leqq 60$$

Niobium (Nb) and titanium (Ti) fix solute carbon and nitrogen by forming compounds with them, thereby improving the corrosion resistance and increasing the revalue. Niobium and titanium are required either alone or in combination. At a content of less than about 0.01%, neither niobimn nor titanium achieves sufficient effects. Thus, both the Nb content and the Ti content are preferably not less than 0.01%. On the other hand, a Nb content exceeding about 0.8% causes deterioration in the toughness, and a Ti content exceeding about 1.0% causes deterioration in the appearance and toughness. Thus, the Nb content should be not more than about 0.8% and the Ti content should be not more than about 1.0%. More preferably, the Nb content is in the range of about 0.05% to about 0.40% and the Ti content is in the range of about 0.05% to about 0.40%.

In order to fix carbon and nitrogen as carbides and nitrides in the steel and to achieve further superior formability, the Nb content and the Ti content should satisfy the following relationship:

$$18 \leqq Nb/(C+N)+2Ti/(C+N) \leqq 60$$

More preferably, the following relationship is satisfied:

$$20 \leqq Nb/(C+N)+2Ti/(C+N) \leqq 50$$

In these relationships, C, N, Nb, and Ti represent the C, N, Nb and Ti contents by mass percent, respectively.

The balance of the composition is basically iron (Fe) and unavoidable impurities. In view of improving the brittleness of the grain boundaries, copper (Co) and boron (B) may be contained at a content of not more than about 0.3% and not more than about 0.01%, respectively. The characteristics of the stainless steel of the present invention will not be affected in the presence of not more than about 0.5% Zr, not more than about 0.1% Ca, not more than about 0.3% Ta, not more than about 0.3% W, not more than about 1% Cu, and not more than about 0.3% Sn.

Average r-Value: at least 2.0

In order for the stainless steel sheet to achieve high deep-drawability comparable to that of ternesheets which have been conventionally used in fuel tanks and to achieve high formability which meets the demand for mass production, the average r-value of the steel sheet needs to be at least 2.0.

Thus, in the invention, the average r-value of the steel sheets is limited to at least 2.0, and more preferably, at least about 2.2. Herein, the average r-value is defined as the average plastic strain ratio determined by the equation below according to JIS Z 2254:

$$r=(r_0+2r_{45}+r_{90})/4$$

wherein, $r_0$ denotes a plastic strain ratio measured using a test piece sampled in parallel to the rolling direction of the sheet;

$r_{45}$ denotes a plastic strain ratio measured using a test piece sampled at 45° to the rolling direction of the sheet; and $r_{90}$ denotes a plastic strain ratio measured using a test piece which is sampled at 90° to the rolling direction of the sheet.

Since workability is affected by the grain size of the finished annealed sheet, the crystal grain size number of the finished cold-rolled sheet must be not less than about 6.5.

To achieve an average r-value of not less than 2.0, the X-ray integral intensity ratio of (222) to (200), i.e., (222)/(200), needs to be not less than about 15.0. The X-ray integral intensity ratio (222)/(200) is closely related to the r-value of the steel sheet and a higher (222)/(200) ratio results in a higher r-value. Herein, the X-ray integral intensity ratio (222)/(200) refers to the integral intensity ratio of the (222) peak to the (200) peak measured with an X-ray diffractometer RINT1500 manufactured by Rikagaku Denki Co., Ltd. at a position ¼ of the sheet thickness using a Co κα beam by a θ-20 method at a voltage of 46 kV and current of 150 mA.

A method for manufacturing the steel sheet of the composition of the invention exhibiting an X-ray integral intensity ratio (222)/(200) of not less than about 15.0 is described in later sections. Ferrite crystal grain size number of finished annealed sheet: not less than about 6.0

Figure 2:
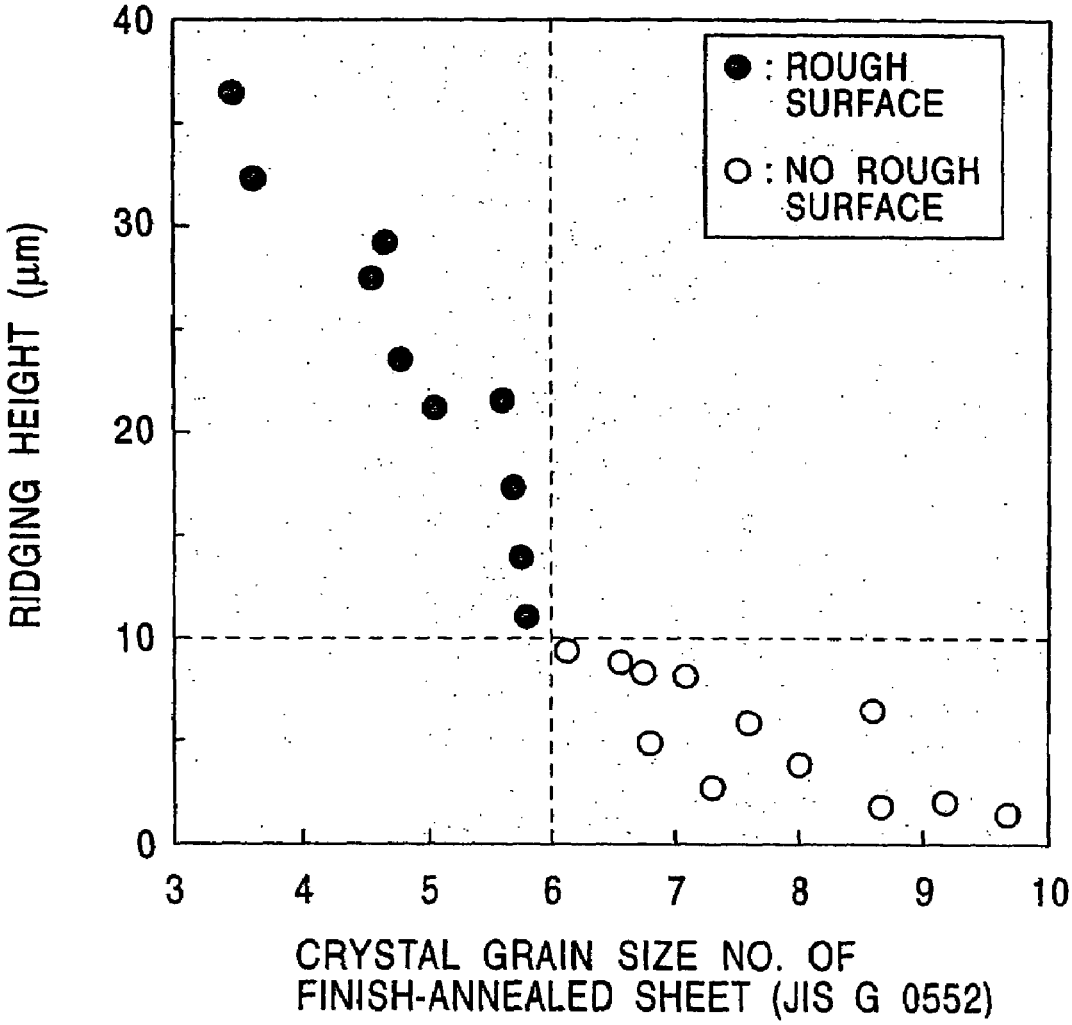
FIG. 2 is a graph showing the relationship between crystal grain size numbers of finish-annealed sheet and surface roughness (ridging height) after forming.

As shown in FIG. 2, the ferrite crystal grain size of the finished annealed sheets is closely related to the generation of rough surfaces after the steel sheet has been subjected to a forming process. Larger crystal grains of a grain size number of less than about 6.0 not only generate rough surfaces, known as "orange peel", on the formed product thereby impairing the appearance, but also cause deterioration in the corrosion resistance as a result of the rough surface. Thus, the grain size number of the finished annealed sheet should be not less than about 6.0, and more preferably, not less than about 7.0.

All the grain size numbers described in the invention are measured by a method according to JIS G 0552 in which an average of the crystal grain size numbers measured at positions corresponding to ½, ¼, and ⅙ of the sheet thickness at four points for each of the positions (a total of 12 points) in a cross section taken in the rolling direction (L direction) is defined as the grain size number.

Although the (222)/(200) intensity ratio can be increased merely by increasing the finish annealing temperature, the problem of employing such method is that high annealing temperature coarsens the crystal grains in achieving the average r-value of not less than 2.0, thereby generating rough surfaces. In the invention, to yield these apparently incompatible advantages at the same time, cold rolling is performed twice or more with an intermediate annealing process therebetween.

FIG. 2 is a graph illustrating the relationship between the crystal grain size number of the finished annealed sheet and the surface roughness of the processed sheet in terms of ridging height. For these data, the crystal grain size number before the final cold-rolling was made uniform to 6.7. The ridging height was determined and evaluated by measuring the surface roughness of JIS No. 5 test pieces taken in the steel-sheet rolling direction (L direction) after application of 25% tensile strain employing a stylus method. FIG. 2 shows that the test pieces having about 6.0 or more of the crystal grain size number exhibit a ridging height of 10 μm or less and that the roughness of the surface can be remarkably improved at a crystal grain size number of not less than about 6.0.

A method for making the ferritic stainless steel sheet of the invention having the above-described X-ray integral intensity ratio and the ferrite crystal grain size number will now be described.

The steel sheet of the invention is a cold-rolled steel sheet manufactured by a steel-making process, hot-rolling process, hot-rolled sheet annealing process, pickling process, cold-rolling process, and finish annealing process. By controlling the slab heating temperature, hot rough rolling conditions, and hot finish rolling conditions during the hot-rolling process, the annealing temperature during hot-rolled sheet annealing process, cold rolling conditions and the intermediate-annealing temperature during the cold rolling process, and the annealing temperature during the finish annealing process, the X-ray integral intensity ratio and the ferrite crystal grain size number can be controlled within the above-described ranges. The details are described below. Slab heating temperature: about 1,000° C. to about 1,200° C.

Hot rough rolling under predetermined conditions is difficult at excessively low slab heating temperatures. On the other hand, at excessively high slab heating temperatures, $Ti_4C_2S_2$ contained in the slab of the Ti-alloyed steel dissolves to give an increased amount of solute carbon and inhomogeneous aggregation structure in the hot-rolled sheet thickness direction. Thus, the slab heating temperature is preferably in the range of about 1,000° C. to about 1,200° C., and more preferably, in the range of about 1,100° C. to about 1,200° C.

Hot Rough Rolling:

Hot rough rolling (hereinafter, simply referred to as rough rolling) in which the rolling temperature of at least one pass is in the range of about 850° C. to about 1,100° C. is performed at a reduction of about 35%/pass or more. At a rough rolling temperature below about 850° C., recrystallization barely progresses and the resulting finished annealed sheet will exhibit poor workability and large planar anisotropy. Moreover, the load on the rollers increases resulting in a shorter roller life. At a rough rolling temperature exceeding about 1,100° C., the structure of the ferrite crystal grains is stretched in the rolling direction, resulting in larger anisotropy. Thus, the rough rolling temperature is preferably in the range of about 850° C. to about 1,100° C., and more preferably, about 900° C. to about 1,050° C.

At a reduction below about 35%/pass, a band of large amounts of unrecrystallized portions remains at the center in the sheet thickness direction, and the workability is degraded thereby. At a reduction exceeding about 60%/pass, seizure and biting failure may result. Thus, the reduction is preferably in the range of about 40 to about 60%/pass. Note that with steel materials having low hot strengths, strong shear strain would be generated on the steel sheet surface during rough rolling, unrecrystallized portions would remain in the center portions in the sheet thickness direction, and seizure would occur in some cases. To overcome these disadvantages, lubrication may be required to improve the coefficient of friction to about 0.3 or less.

The deep-drawability can be improved by performing at least one pass of rough rolling in which the above-described conditions of rough rolling temperature and reduction are satisfied. This at least one pass may be performed at any pass during rough rolling. Preferably, this pass is performed at the final pass, considering the performance of the rolling mill.

Hot Finish Rolling:

During hot finish rolling (hereinafter, simply referred to as finish rolling) performed subsequent to rough rolling, the rolling temperature of at least one pass must be in the range of about 650° C. to about 900° C., and the reduction must be in the range of about 20 to about 40%/pass. At a rolling temperature below about 650° C., a reduction of about 20%/pass or more is difficult to achieve due to an increase in the deformation resistance, and the load on the rollers is increased. At a finish rolling temperature exceeding about 900° C., accumulation of rolling strain becomes smaller, thereby minimizing the effect of improvement in workability in the following steps. Thus, the finish rolling temperature is preferably in the range of about 650° C. to about 900° C., and more preferably, about 700° C. to about 800° C.

At a reduction below of about 20%/pass at a temperature in the range of about 650° C. to about 900° C., significantly large colonies of {100}//ND, i.e., {100} planes parallel to the normal direction (rolling direction), and {110}//ND, i.e., {110} planes parallel to the normal direction, which cause ridging and a decrease in the r-value remain. At a reduction exceeding about. 40%/pass, biting and/or shaping failure causing degradation of the surface characteristics of the steel occurs. Thus, the reduction of at least one pass during finish rolling is preferably in the range of about 20 to about 40%/pass, and more preferably, about 25 to about 35%/pass.

The deep-drawability can be improved by performing at least one pass of finish rolling in which the above-described rolling temperature and the reduction conditions are satisfied. This at least one pass may be performed at any pass but most preferably at the final pass, considering the performance of the rolling mill.

Hot-Rolled-Sheet Annealing:

A hot-rolled-sheet annealing temperature below about 800° C. causes insufficient recrystallization and a decrease in the r-value. Moreover, significant ridging is observed in the finished annealed sheet due to a band-shaped unrecrystallized structure. At a temperature exceeding about 1,100° C., not only does the structure become coarse but also an increased amount of solute carbon due to dissolved carbides in the steel precludes the formation of a preferable aggregation structure. Moreover, rough surfaces after forming cause degradation in the process limit and corrosion resistance. In view of the above, the conditions of hot-rolled-sheet annealing should be optimized to obtain a structure as fine as possible and free of unrecrystallized structure, although the conditions may vary in relation to solute carbon, i.e., precipitation behavior of carbides. In particular, the temperature of hot-rolled-sheet annealing is preferably in the range of about 800° C. to about 1,100° C., and more preferably, about 850° C. to about 1,050° C.

Cold Rolling

Cold rolling is performed at least twice at a temperature of about 750° C. to about 1,000° C. with an intermediate annealing process therebetween. The gross reduction must be not less than about 75%, and the reduction ratio expressed by (reduction of the first cold-rolling)/(reduction of the second cold-rolling) should be in the range of about 0.7 to about 1.3. The ferrite crystal grain size number immediately before final cold rolling should be about 6.5 or more.

An intermediate-annealing temperature below about 750° C. results in insufficient recrystallization and a decrease in the r-value. Moreover, significant ridging in the final cold-rolled annealed sheet occurs due to the band-shaped unrecrystallized structure. At an intermediate-annealing temperature exceeding about 1,000° C., the structure becomes coarse and increased amounts of solute carbon resulting from carbides dissolving into solid solutions precludes the formation of a preferred aggregation structure such as {111} for improving deep-drawability. Moreover, significant ridging is observed in the final cold-rolled annealed sheet.

In manufacturing finished annealed sheets having fine crystal grains and high r-values, reducing the amount of solute carbons before the final cold rolling and miniaturizing the ferrite crystal grains (to not less than about 6.5 in grain size number) after the intermediate annealing and before the final cold rolling are essential. Thus, the intermediate-annealing temperature should be set at a temperature as low as possible as long as the crystal grain size number is not less than about 6.5 and no unrecrystallized structures remain in the steel.

In view of the above, the intermediate-annealing temperature should be in the range of about 750° C. to about 1,000° C., and more preferably, about 800° C. to about 950° C.

In cold rolling, a gross reduction of not less than about 75% is achieved by performing cold-rolling at least twice with the above-described intermediate annealing process therebetween. During twice or more of cold rolling, the reduction ratio expressed as (reduction in the first cold rolling)/(reduction in the final cold rolling) is in the range of about 0.7 to about 1.3. In particular, if the cold rolling is performed twice, the reduction ratio is determined by (reduction in the first cold rolling)/(reduction in the second cold rolling), and the obtained value should be in the above-described range.

A higher gross reduction contributes to the development of {111} aggregation structure in the finished annealed sheet and to achievement of higher r-values. In order for the finished annealed sheet to achieve an average r-value of about 2.0 or more, the gross reduction needs to be not less than about 75%. Thus, in the invention, the gross reduction needs to be not less than about 75%. Since cold reduction peaks at around about 85%, the more preferable range of the gross reduction is between about 80% and about 90%.

The reduction ratio of the twice or more of cold rolling is closely related to the grain sizes before the final cold rolling, the development of the {111} aggregated structure in the intermediate-annealed sheet, and the development of the {111} aggregated structure in the finish-annealed sheet. The reduction ratio during cold rolling is preferably in the range of about 0.7 to about 1.3, and more preferably in the range of about 0.8 to about 1.1 to attain higher r-values. In performing twice of more of cold rolling, the reduction of each cold rolling is preferably not less than about 50% and the difference in the reductions between each cold rolling is preferably not more than about 30%. This is because at a reduction below about 50% and a reduction difference exceeding about 30%, the ratio (222)/(200) becomes remarkably low, resulting in lower r-values.

In the cold rolling process of the invention, a tandem roller mill with work rollers having a roller diameter of about 300 mm or more is preferably used to roll the sheet in one direction during the said twice or more of cold rolling.

Control of the roller diameter and the rolling direction is essential for reducing the shear deformation of the rolled sheet and increasing the ratio (222)/(200) to improve the r-value. Generally, the final cold rolling of stainless steels is performed using smaller work rollers having a roller diameter of, for example, about 200 mm or less to obtain shiny surfaces. Since the invention specifically seeks to improve the r-value, large work rollers having a diameter of about 300 mm or more are preferably used even in the final cold rolling.

In other words, tandem rolling in one direction using rollers having a roller diameter of not less than about 300 mm is preferred over reversing rolling using rollers having a roller diameter of about 100 to about 200 mm in view of reducing the shear deformation at the surfaces and improving the revalue.

Figure 3:
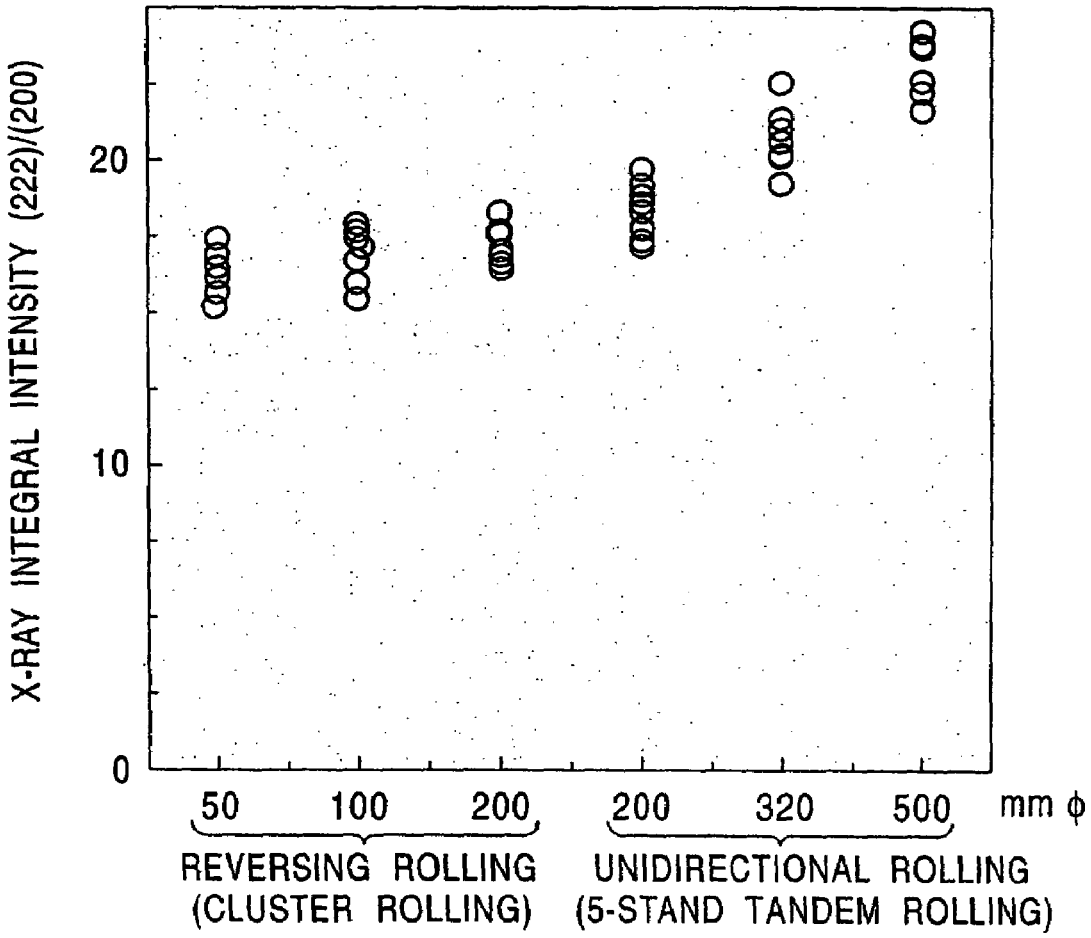
FIG. 3 is a graph showing the effect of cold roller diameters and rolling directions on X-ray integral intensity ratios (222)/(200)

FIG. 3 shows the relationship of the X-ray integral intensity ratio (222)/(200) to the cold-roller diameter and the rolling methods. It is clear from FIG. 3 that the ratio (222)/(200) increases by using large-diameter work rollers and employing unidirectional rolling (tandem rolling).

In order to reliably achieve higher r-values, a load per unit width is increased to apply uniform strain in the sheet thickness direction. Such an application of uniform strain can be effectively achieved by any one or combination of decreasing the hot-rolling temperature, formation of high alloys, and increasing the hot-rolling rate.

Crystal Grain Size Number before Final Cold Rolling: not less than about 6.5

The ferrite crystal grain size number before the final cold rolling (after second cold rolling if the number of times of the cold rolling is 2) is an important factor closely related to the ratio (222)/(200), the r-value of the finished annealed sheet, and the grain size of the finished annealed sheet which will cause rough surfaces after forming. The inventors have found for the first time that a crystal grain size number of not less than about 6.0 and a ratio (222)/(200) of not less than about 15.0 can be achieved by controlling the crystal grain size number before the final cold annealing to not less than about 6.5. Ferritic stainless steel sheets free of rough surfaces after forming exhibiting a superior deep-drawability of an r-value of 2.0 or more can be thereby manufactured.

The larger the crystal grain size number (smaller the crystal grain diameter) before the final cold annealing, the higher the development of {111}//ND. Even when the crystal grain diameters of the finished annealed sheets are the same, a sheet having a larger crystal grain size number before the final cold rolling will exhibit a higher revalue. This is because, in the sheets having larger crystal diameter size number before the final cold rolling, solute carbon increases as a result of carbides such as TiC and NbC dissolving and forming solid solutions and precludes the development of the aggregated structure. Also, this is because such a sheet has a low (222)/(200) as a result of fewer recrystallization nucleating sites and cannot obtain high r-values.

Figure 4:
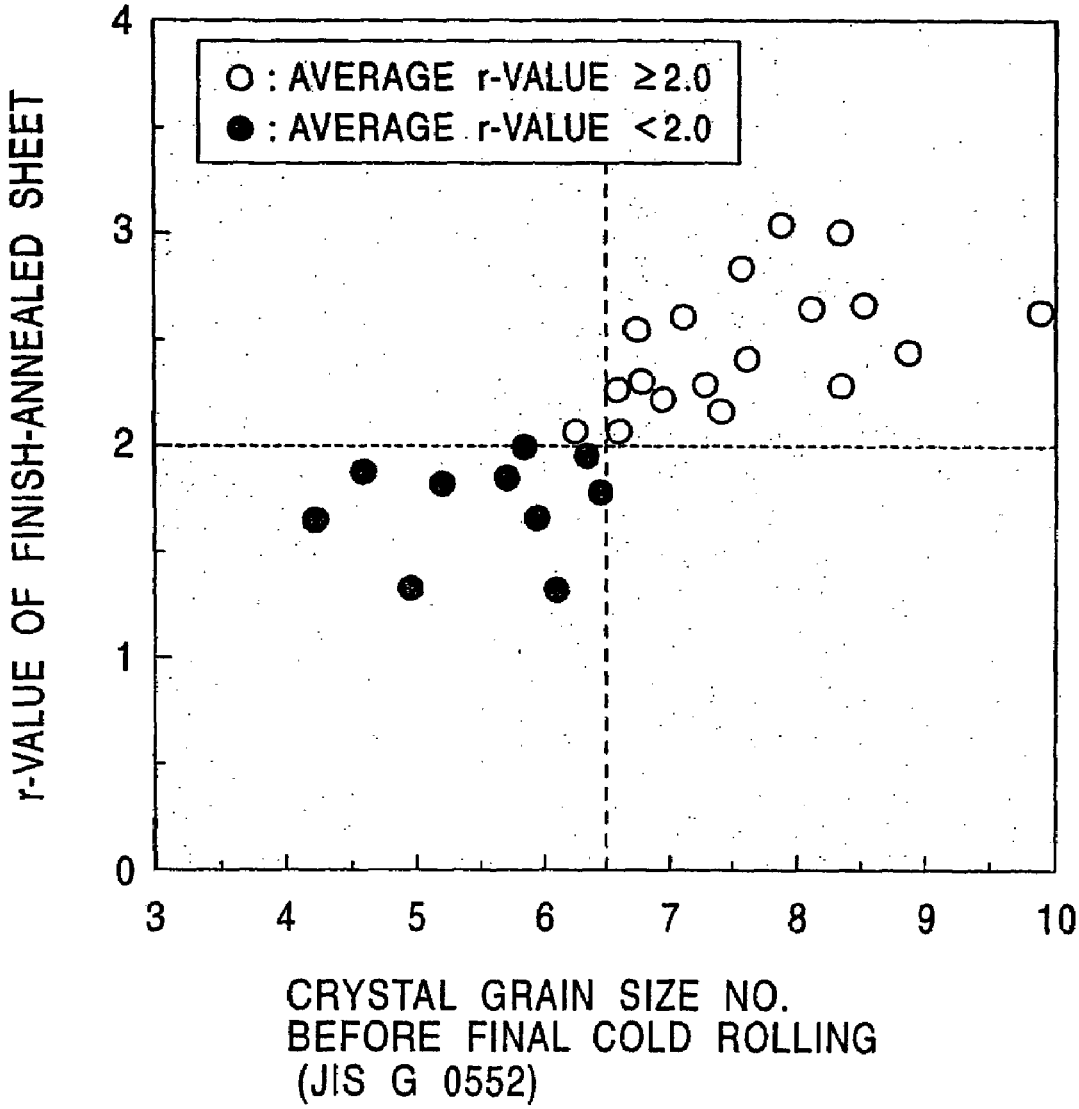
FIG. 4 is a graph showing the effect of crystal grain size numbers before final cold rolling on r-values of finish-annealed sheet.

FIG. 4 is a graph showing the relationship between the crystal grain size number before the final cold rolling and the r-value of the finish-annealed sheet. Here, the crystal grain size numbers of the finish-annealed sheets are made uniform to about 6.5 by modifying the finish annealing temperatures. FIG. 4 demonstrates that the r-values of the finish-annealed sheets are higher for the smaller crystal grain diameter before the final cold rolling. In the case where the crystal grain size numbers before the final cold rolling are the same, the r-values of the finished annealed sheets can be further improved by reducing the hot-rolled sheet annealing grain diameter.

As described above, ferritic stainless steel sheets free of rough surfaces after forming and exhibiting high r-values can be manufactured by controlling the ferrite crystal grain size numbers before the final cold rolling to not less than about 6.5.

Finish Annealing (Final Cold-Rolled Sheet Annealing):

The higher the finish annealing temperature, the higher the {111} accumulation and r-values. This is because the {111} crystal grains grow while invading the grains of other crystal orientations. In the regions where unrecrystallized structures remain, however, preferential growth of the {111} crystal grains effective for improving the r-values is not observed and ridging is significant. In other words, with remaining unrecrystallized structures, an average revalue of 2.0 or more cannot be achieved and the deep-drawability and the workability are remarkably impaired by the band-shaped structure remaining in the center in the steel sheet thickness direction.

Although the r-value can be remarkably improved by promoting preferential growth of the {111} grains through high-temperature finish annealing, the crystal grains become excessively large, resulting in rough surfaces (orange peel) after forming and in degradation of the formability and corrosion resistance. Thus, the finish annealing temperature should be kept in the range in which the crystal grain size number of not less than about 6.0 is reliably achieved. In the case where the brittleness to secondary working is important, the crystal grains should be finer, for example, the crystal grain size number is preferably not less than about 7.0. At a finish annealing temperature below about 800° C., crystal orientations effective for improving the r-values cannot be obtained, an average r-value of not less than about 2.0 cannot be achieved, and the deep-drawability is impaired due to the band-shaped unrecrystallized structure remaining in the center in the steel sheet thickness direction.

In view of the above, the finish annealing should be conducted at a temperature in the range of about 850° C. to about 1,050° C., and more preferably, about 880° C. to about 1,000° C. in the present invention.

Lubricant Coat:

For the purpose of omitting application of lubricant vinyl or lubricant oil during severe forming into complicated shapes or press forming, it is effective to apply a lubricant coat on the surface of the above-described steel sheet at a coating amount per area of about 0.5 to about 4.0 g/m$^2$. The lubricant coat of the invention is acrylic-resin based and contains about 3 to about 20 percent by volume of stearate calcium and about 3 to about 20 percent by volume of polyethylene wax.

The applied lubricant coat improves sliding performance of the steel sheet and facilitates deep-drawing into complicated shapes. Preferably, the lubricant coat is readily removable with alkali. If the lubricant coat remains on the steel sheet which is subjected to spot welding or seam welding after forming, the welded parts sensitive to the lubricant coat would exhibit significantly poor corrosion resistance.

The results of the press forming test demonstrate that the application amount of the lubricant coat should be at least about 0.5 g/m$^2$ to improve the sliding performance. At an application amount exceeding about 4.0 g/m$^2$, the effect of improving the sliding performance is saturated. Moreover, if a steel sheet provided with such a coat is seam-welded or spot-welded without removing the coat, electrical conduction failure will occur and the weldability of the steel sheet will be impaired because the welded parts are sensitive to the lubricant coat. In achieving both good weldability and formability, the coating amount is preferably in the range of about 1.0 to about 2.5 g/m$^2$. The lubricant coat may be provided on one or preferably both surfaces of the steel sheet.

When the above-described invention steel sheet is made into fuel pipes by welding, all of the commonly known welding methods including arc welding such as tungsten inert gas (TIG) welding, metal inert gas (MIG) welding, and electric resistance welding (ERW), and laser welding can be applied.

EXAMPLES

Example 1

Steel slabs having the compositions shown in Table 1 were hot rolled under conditions shown in Table 2 and subjected to cold rolling, intermediate rolling, and finish rolling under the conditions shown in Table 3. The X-ray integral intensity ratios (222)/(200) of the resulting finished annealed sheets were measured at a plane parallel to the sheet surface at a position corresponding to ¼ of the sheet thickness. The ferrite crystal grain size number of each sheet was measured according to JIS G 0552 (sectioning method) at positions corresponding to ½, ¼, and ⅙ of the sheet thickness in a cross section taken in the rolling direction (L direction). The measured grain size numbers and the X-ray integral intensity ratios are shown in Table 4.

Next, a JIS No. 13B test piece was taken from each sheet, and a 15% uniaxial tension prestrain was applied to the test piece. The r-values $r_0$, $r_{45}$, and $r_{90}$ according to a three-point method sere measured and the average r-value (n=3) was calculated according to the equation below:

$$r=(r_0+2r_{45}+r_{90})/4$$

wherein $r_0$, $r_{45}$, and $r_{90}$ represent the r-values in parallel to the rolling direction, at 45° C. relative to the rolling direction, and at 90° relative to the rolling direction, respectively. The results are shown in Table 4.

The surface roughness and the corrosion resistance were examined by the methods below.

Surface Roughness

In assessing the surface roughness (Ry), a JIS NO. 5 test piece was taken in the steel-sheet rolling direction from each sheet and subjected to 25% tension prestrain. The surface roughness of the test piece was then measured in the direction perpendicular to the tension direction for a length of 1 cm by a stylus method to determine the ridging height on the steel sheet surface.

The measurement was performed at five points with intervals of 5 mm in the longitudinal direction in the region ±10 mm from the center of the test piece in the longitudinal direction, and the largest ridging height was determined.

The results are shown in FIG. 4. The test pieces having the maximum ridging height of not more than 10 μm were evaluated as having a satisfactory smooth surface.

Corrosion Resistance

Each test piece was prepared by drawing a finish-annealed sheet 0.8 mm in thickness into a cylindrical test piece having a diameter of 80 mm and a height of 40 mm. Deteriorated gasoline containing 800 ppm of formic acid was placed in the test piece and left to stand for 25 hours in a 50° C. thermobath, which corresponds to one cycle. After each cycle, deteriorated gasoline was added to compensate for the evaporated gasoline. The cycle was repeated 200 times (a total of 5,000 hours), and the appearance of red rust after 200 cycles was visually observed. The results are shown in Table 4.

Referring to Table 4, test pieces Nos. 1 to 6 were controlled to have different crystal grain diameters by subjecting a 0.75-mm-thick cold rolled sheet having the composition of steel No. 1 in Table 1 to finish annealing of various different conditions. Test pieces Nos. 1 to 4 had a grain size number after finish annealing of 6.0 or more and exhibited high average r-values exceeding 2.0. Test pieces Nos. 5 and 6 had a grain size number after finish rolling of less than 6.0 and a maximum ridging height exceeding 10 μm, although the r-values were over 2.0. Test pieces No. 5 and 6 developed red rust in the corrosion testing. Test pieces Nos. 7 to 10 also used steel No. 1 in Table 1 but with different intermediate-annealing temperatures as shown in Table 3. In test pieces Nos. 8 to 10 with a grain size number before second cold rolling of less than 6.5, although a r-value exceeding 2.0 was obtained, the {111} aggregation structure preferable for improving the r-value of the cold-rolled annealed sheet did not develop sufficiently. As a result, the grain size number after finish annealing was less than about 6.0, and such coarse grains resulted in a maximum ridging height exceeding about 10 μm and a significantly rough surface. Particularly in test pieces No. 9 and 10 with a crystal grain size number of less than 5.5, extensive undulating ridging with a ratio (222)/(200) of less than 15 and a maximum ridging height exceeding 70 μm was observed. In test pieces Nos. 11 and 12, the reduction ratio (reduction in the first cold rolling/reduction in the second cold rolling) was modified. The reduction ratios of test pieces Nos. 11 and 12 were 50%/72% (0.69) and 71%/53% (1.34), respectively. Compared to test piece No. 3 according to the invention, it can be understood that the reduction ratio of the cold-rolled annealed sheet affects grain diameters and r-values and that the closer the reduction ratio is to 1.0, the higher the revalue (the finer the structure) of the cold-rolled annealed sheet.

Test pieces No. 13 and 14 display the effects of hot-rolled sheet structures on the material characteristics of the finished sheets. Particularly, test piece No. 13 subjected to low-temperature annealing at 790° C. had a band-shaped unrecrystallized structure remaining in the sheet although not shown in Table 4, and exhibited low (222)/(200) and an r-value of approximately 1.7. Moreover, although the crystal grains of test piece No. 13 were fine, the surface was remarkably rough with a maximum ridging height of 33 μm. Test piece No. 14 subjected to a high hot-rolled-sheet annealing temperature of 1,120° C. had coarse grains after the hot annealing. Similarly to test piece No. 13, the r-value of test piece No. 14 was low and the surface was remarkably rough. Test pieces Nos. 15 to 19 showed effects of the rolling conditions on the finished sheets. The r-values improved and the maximum ridging height decreased by using large diameter rollers and performing unidirectional reversing rolling. Test pieces No. 20 to 24 were subjected to single cold rolling at a cold reduction of 87% to examine the resulting r-values. In test pieces Nos. 20 to 22 with a crystal grain size number of the finished cold-rolled sheet of 6.0 or more, the resulting r-values were approximately 1.7 at the highest. In test pieces Nos. 25 to 33, the composition of the material steel was modified. Test piece No. 27 using steel No. 4 had a sufficiently small ridging height but developed red rust in the corrosion testing to deteriorated gasoline due to low Cr+3.3 Mo of 16.5. Test piece No. 29 used hard steel having a high Cr content of 24% and exhibited an average r-value of 2.1. Test piece No. 30 using steel No. 7 developed red rust in the corrosion resistance testing with deteriorated gasoline due to low Mo content of 0.4% and low Cr+3.3Mo of 17.3. Test piece No. 32 using steel No. 9 had a Mo content of 3.2% which exceeded 3.0% thus failing to obtain an r-value exceeding 2.0.

TABLE 1

| | Composition (mass %) | | | | | | | | | | | | | | |
|---|---|---|---|---|---|---|---|---|---|---|---|---|---|---|---|
| Steel No. | C | Si | Mn | P | S | Cr | Ni | Mo | N | Al | Nb | Ti | Cr + 3.3Mo | Nb/(C + N) + 2Ti/(C + N) | Remarks |
| | 0.003 | 0.081 | 0.14 | 0.03 | 0.006 | 18 | 0.15 | 1.21 | 0.005 | 0.15 | 0.001 | 0.160 | 22.0 | 40.1 | Ex.* |
| 2 | 0.006 | 0.006 | 0.25 | 0.023 | 0.006 | 16 | 0.55 | 0.9 | 0.008 | 0.2 | 0.01 | 0.220 | 19.0 | 32.1 | Ex. |
| 3 | 0.010 | 0.2 | 0.07 | 0.019 | 0.005 | 18.2 | 0.65 | 1.3 | 0.032 | 0.18 | 0.1 | 0.400 | 22.5 | 21.4 | Ex. |
| 4 | 0.020 | 0.011 | 0.25 | 0.022 | 0.018 | 10.2 | 1.8 | 1.9 | 0.014 | 0.1 | 0.02 | 0.210 | 16.5 | 12.9 | Cex.* |
| 5 | 0.003 | 0.012 | 0.1 | 0.031 | 0.005 | 17.5 | 0.25 | 1.2 | 0.008 | 0.5 | 0.15 | 0.230 | 21.5 | 55.5 | Ex. |
| 6 | 0.009 | 0.088 | 0.04 | 0.024 | 0.005 | 24 | 0.61 | 1.7 | 0.008 | 0.05 | 0.02 | 0.240 | 29.6 | 29.4 | Cex. |
| 7 | 0.008 | 0.01 | 0.08 | 0.023 | 0.003 | 16 | 0.45 | 0.4 | 0.008 | 0.4 | 0.03 | 0.220 | 17.3 | 29.4 | Cex. |
| 8 | 0.008 | 0.21 | 0.1 | 0.0018 | 0.005 | 18 | 0.5 | 0.7 | 0.006 | 0.01 | 0.05 | 0.21 | 20.3 | 33.6 | Ex. |
| 9 | 0.010 | 0.012 | 0.08 | 0.002 | 0.006 | 13.2 | 0.01 | 3.2 | 0.012 | 0.02 | 0.02 | 0.24 | 23.8 | 22.7 | Cex. |
| 10 | 0.005 | 0.0012 | 0.1 | 0.003 | 0.004 | 17.1 | 0.12 | 0.6 | 0.007 | 0.02 | 0.3 | 0.01 | 19.1 | 26.7 | Ex. |

*Ex. denotes Example of the invention.
*Cex. denotes Comparative Example.

TABLE 2

| | | | Rough-rolling conditions | | Finish-rolling conditions | | | | Hot-rolled-sheet annealing | |
|---|---|---|---|---|---|---|---|---|---|---|
| No. | Steel No. | Slab heating temperature (° C.) | Rolling temperature at maximum reduction pass (° C.) | Maximum reduction (%/pass) | Rolling temperature at maximum reduction pass (° C.) | Maximum reduction (%/pass) | Gross hot reduction (%) | Hot finishing temperature (° C.) | Temperature (° C.) | Holding time (s) |
| 1 | 1 | 1100 | 1040 | 40 | 780 | 25 | 80 | 780 | 890 | 60 |
| 2 | 1 | 1150 | 1000 | 35 | 770 | 30 | 80 | 780 | 895 | 60 |

TABLE 2-continued

| No. | Steel No. | Slab heating temperature (° C.) | Rough-rolling conditions: Rolling temperature at maximum reduction pass (° C.) | Rough-rolling conditions: Maximum reduction (%/pass) | Finish-rolling conditions: Rolling temperature at maximum reduction pass (° C.) | Finish-rolling conditions: Maximum reduction (%/pass) | Gross hot reduction (%) | Hot finishing temperature (° C.) | Hot-rolled-sheet annealing: Temperature (° C.) | Hot-rolled-sheet annealing: Holding time (s) |
|---|---|---|---|---|---|---|---|---|---|---|
| 3 | 1 | 1150 | 1050 | 40 | 780 | 25 | 80 | 785 | 895 | 60 |
| 4 | 1 | 1120 | 1050 | 45 | 740 | 30 | 80 | 780 | 890 | 60 |
| 5 | 1 | 1148 | 1050 | 42 | 770 | 27 | 80 | 780 | 890 | 60 |
| 6 | 1 | 1154 | 1050 | 40 | 750 | 35 | 80 | 777 | 890 | 60 |
| 7 | 1 | 1150 | 1050 | 45 | 770 | 40 | 80 | 780 | 888 | 60 |
| 8 | 1 | 1145 | 1045 | 35 | 770 | 35 | 80 | 780 | 890 | 60 |
| 9 | 1 | 1150 | 1050 | 30 | 780 | 25 | 78 | 780 | 890 | 60 |
| 10 | 1 | 1150 | 1050 | 40 | 770 | 25 | 80 | 790 | 890 | 60 |
| 11 | 1 | 1130 | 1050 | 40 | 750 | 30 | 80 | 790 | 890 | 60 |
| 12 | 1 | 1150 | 1050 | 40 | 770 | 30 | 80 | 780 | 890 | 60 |
| 13 | 1 | 1150 | 1045 | 40 | 770 | 30 | 80 | 780 | 790 | 60 |
| 14 | 1 | 1151 | 1055 | 45 | 810 | 30 | 81 | 780 | 1120 | 61 |
| 15 | 1 | 1170 | 1050 | 40 | 800 | 30 | 80 | 780 | 890 | 60 |
| 16 | 1 | 1150 | 1045 | 40 | 750 | 30 | 79 | 780 | 892 | 60 |
| 17 | 1 | 1150 | 1050 | 40 | 750 | 25 | 80 | 766 | 890 | 60 |
| 18 | 1 | 1150 | 1055 | 50 | 770 | 30 | 80 | 780 | 888 | 59 |
| 19 | 1 | 1128 | 1050 | 50 | 800 | 30 | 80 | 780 | 890 | 60 |
| 20 | 1 | 1139 | 1045 | 52 | 730 | 30 | 80 | 780 | 878 | 60 |
| 21 | 1 | 1150 | 1050 | 47 | 780 | 30 | 81 | 781 | 890 | 60 |
| 22 | 1 | 1155 | 1050 | 50 | 780 | 30 | 80 | 780 | 891 | 60 |
| 23 | 1 | 1150 | 1050 | 50 | 770 | 30 | 80 | 779 | 891 | 60 |
| 24 | 1 | 1154 | 1055 | 38 | 780 | 30 | 80 | 780 | 890 | 60 |
| 25 | 2 | 1030 | 1050 | 35 | 780 | 30 | 80 | 780 | 890 | 60 |
| 26 | 3 | 1100 | 1080 | 45 | 780 | 30 | 80 | 780 | 893 | 60 |
| 27 | 4 | 1080 | 1100 | 45 | 750 | 30 | 80 | 780 | 890 | 60 |
| 28 | 5 | 1150 | 1020 | 40 | 780 | 30 | 80 | 780 | 890 | 60 |
| 29 | 6 | 1030 | 1100 | 40 | 720 | 28 | 80 | 780 | 890 | 60 |
| 30 | 7 | 1150 | 1050 | 40 | 720 | 30 | 80 | 780 | 880 | 60 |
| 31 | 8 | 1150 | 1050 | 40 | 750 | 30 | 80 | 780 | 890 | 60 |
| 32 | 9 | 1150 | 1050 | 40 | 750 | 30 | 80 | 780 | 875 | 60 |
| 33 | 10 | 1150 | 1050 | 40 | 770 | 29 | 80 | 780 | 890 | 60 |

TABLE 3

| No. | Steel No. | First cold rolling: Reduction (%) | First cold rolling: Roller diameter (*) | Intermediate annealing: Performance | Intermediate annealing: Temperature (° C.) | Intermediate annealing: Holding time (s) |
|---|---|---|---|---|---|---|
| 1 | 1 | 60 | 500(T) | performed | 820 | 30 |
| 2 | 1 | 60 | 500(T) | performed | 820 | 30 |
| 3 | 1 | 60 | 500(T) | performed | 820 | 30 |
| 4 | 1 | 60 | 500(T) | performed | 820 | 30 |
| 5 | 1 | 60 | 500(T) | performed | 825 | 30 |
| 6 | 1 | 60 | 500(T) | performed | 820 | 30 |
| 7 | 1 | 60 | 500(T) | performed | 850 | 30 |
| 8 | 1 | 60 | 500(T) | performed | 900 | 30 |
| 9 | 1 | 60 | 500(T) | performed | 950 | 30 |
| 10 | 1 | 60 | 500(T) | performed | 745 | 30 |
| 11 | 1 | 50 | 500(T) | performed | 830 | 30 |
| 12 | 1 | 71 | 500(T) | performed | 830 | 30 |
| 13 | 1 | 60 | 500(T) | performed | 830 | 30 |
| 14 | 1 | 60 | 500(T) | performed | 851 | 30 |
| 15 | 1 | 60 | 500(T) | performed | 850 | 30 |
| 16 | 1 | 60 | 500(T) | performed | 844 | 30 |
| 17 | 1 | 60 | 500(T) | performed | 850 | 30 |
| 18 | 1 | 60 | 500(T) | performed | 849 | 30 |
| 19 | 1 | 60 | 500(T) | performed | 850 | 30 |
| 20 | 1 | 87 | 500(T) | not performed | — | — |
| 21 | 1 | 87 | 500(T) | not performed | — | — |
| 22 | 1 | 87 | 500(T) | not performed | — | — |
| 23 | 1 | 87 | 500(T) | not performed | — | — |
| 24 | 1 | 87 | 500(T) | not performed | — | — |
| 25 | 2 | 60 | 500(T) | performed | 850 | 30 |

TABLE 3-continued

| | | | | | | |
|---|---|---|---|---|---|---|
| 26 | 3 | 60 | 500(T) | performed | 850 | 30 |
| 27 | 4 | 60 | 500(T) | performed | 850 | 30 |
| 28 | 5 | 60 | 500(T) | performed | 850 | 30 |
| 29 | 6 | 60 | 500(T) | performed | 850 | 30 |
| 30 | 7 | 60 | 500(T) | performed | 850 | 30 |
| 31 | 8 | 60 | 500(T) | performed | 850 | 30 |
| 32 | 9 | 60 | 500(T) | performed | 850 | 30 |
| 33 | 10 | 60 | 500(T) | performed | 850 | 30 |

| Grain size No. before second cold rolling | Second cold rolling | | Finish rolling | | Gross cold reduction (%) | Cold reduction ratio $1^{st}/2^{nd}$ | Final sheet thickness (mm) |
|---|---|---|---|---|---|---|---|
| | Reduction (%) | Roller diameter (*) | Temperature (°) | Holding time (s) | | | |
| 7.2 | 66 | 500(T) | 960 | 30 | 85 | 0.91 | 0.75 |
| 7.2 | 66 | 500(T) | 930 | 30 | 85 | 0.91 | 0.75 |
| 7.2 | 66 | 500(T) | 890 | 30 | 85 | 0.91 | 0.75 |
| 7.2 | 66 | 500(T) | 990 | 30 | 85 | 0.91 | 0.75 |
| 7.2 | 66 | 500(T) | 1050 | 30 | 85 | 0.91 | 0.75 |
| 7.2 | 66 | 500(T) | 1100 | 30 | 85 | 0.91 | 0.75 |
| 6.7 | 66 | 500(T) | 960 | 30 | 85 | 0.91 | 0.75 |
| 6.3 | 66 | 500(T) | 960 | 30 | 85 | 0.91 | 0.75 |
| 5.5 | 66 | 500(T) | 960 | 30 | 85 | 0.91 | 0.75 |
| Band remained | 66 | 500(T) | 960 | 30 | 85 | 0.91 | 0.75 |
| 7.1 | 72 | 500(T) | 870 | 30 | 85 | 0.69 | 0.75 |
| 7.2 | 53 | 500(T) | 870 | 30 | 85 | 1.34 | 0.75 |
| 5.5 | 66 | 500(T) | 960 | 30 | 85 | 0.91 | 0.75 |
| 5.1 | 66 | 500(T) | 890 | 30 | 85 | 0.91 | 0.75 |
| 6.7 | 66 | 50(K) | 960 | 30 | 85 | 0.91 | 0.75 |
| 6.7 | 66 | 100(K) | 960 | 30 | 85 | 0.91 | 0.75 |
| 6.7 | 66 | 200(K) | 960 | 30 | 85 | 0.91 | 0.75 |
| 6.7 | 66 | 200(T) | 960 | 30 | 85 | 0.91 | 0.75 |
| 6.7 | 66 | 320(T) | 960 | 30 | 85 | 0.91 | 0.75 |
| — | — | — | 850 | 30 | 87 | — | 0.75 |
| — | — | — | 890 | 30 | 87 | — | 0.75 |
| — | — | — | 930 | 30 | 87 | — | 0.75 |
| — | — | — | 970 | 30 | 87 | — | 0.75 |
| — | — | — | 1000 | 30 | 87 | — | 0.75 |
| 7 | 66 | 500(T) | 920 | 30 | 85 | 0.91 | 0.75 |
| 6.8 | 66 | 500(T) | 950 | 30 | 85 | 0.91 | 0.75 |
| 6.8 | 66 | 500(T) | 961 | 30 | 85 | 0.91 | 0.75 |
| 7.1 | 66 | 500(T) | 890 | 30 | 85 | 0.91 | 0.75 |
| 7.1 | 66 | 500(T) | 960 | 30 | 85 | 0.91 | 0.75 |
| 7 | 66 | 500(T) | 888 | 30 | 85 | 0.91 | 0.75 |
| 7 | 66 | 500(T) | 879 | 30 | 85 | 0.91 | 0.75 |
| 7.1 | 66 | 500(T) | 890 | 30 | 85 | 0.91 | 0.75 |

(*) T: Tandem rolling (unidirectional)
K: Cluster mill (reversing)

TABLE 4

| No. | Steel No. | Grain size No. | X-ray integral intensity ratio (222)/(200) | r-value | Maximum ridging height (μm) | Presence of red rust after corrosion test** | Remarks |
|---|---|---|---|---|---|---|---|
| 1 | 1 | 6.5 | 22.0 | 2.6 | 5.2 | not observed | Ex.* |
| 2 | 1 | 7.5 | 20.0 | 2.5 | <5 | not observed | Ex. |
| 3 | 1 | 8.1 | 16.0 | 2.3 | <5 | not observed | Ex. |
| 4 | 1 | 6.0 | 23.0 | 2.7 | 8.1 | not observed | Ex. |
| 5 | 1 | 5.7 | 25.0 | 2.8 | 20 | observed | Cex.* |
| 6 | 1 | 4.3 | 28.0 | 3.1 | 55 | observed | Cex. |
| 7 | 1 | 6.1 | 21.0 | 2.4 | 9.3 | not observed | Ex. |
| 8 | 1 | 5.6 | 20.0 | 2.4 | 28 | observed | Cex. |
| 9 | 1 | 5.2 | 14.0 | 2.1 | 71 | observed | Cex. |
| 10 | 1 | 5.3 | 8.0 | 1.5 | 75 | observed | Cex. |
| 11 | 1 | 7.8 | 13.0 | 1.9 | 13 | not observed | Cex. |
| 12 | 1 | 7.8 | 12.0 | 1.9 | 15 | not observed | Cex. |
| 13 | 1 | 5.5 | 10.0 | 1.7 | 33 | observed | Cex. |
| 14 | 1 | 5.7 | 10.0 | 1.7 | 41 | observed | Cex. |
| 15 | 1 | 6.2 | 17.0 | 2.25 | 8.5 | not observed | Ex. |

TABLE 4-continued

| No. | Steel No. | Grain size No. | X-ray integral intensity ratio (222)/(200) | r-value | Maximum ridging height (μm) | Presence of red rust after corrosion test** | Remarks |
|---|---|---|---|---|---|---|---|
| 16 | 1 | 6.2 | 17.5 | 2.3 | 7.5 | not observed | Ex. |
| 17 | 1 | 6.2 | 18.0 | 2.35 | 7.4 | not observed | Ex. |
| 18 | 1 | 6.3 | 18.5 | 2.4 | 6.1 | not observed | Ex. |
| 19 | 1 | 6.3 | 20.0 | 2.5 | 5.5 | not observed | Ex. |
| 20 | 1 | 6.8 | 6.0 | 1.4 | 20 | not observed | Cex. |
| 21 | 1 | 6.4 | 7.0 | 1.5 | 25 | not observed | Cex. |
| 22 | 1 | 6.1 | 9.0 | 1.7 | 30 | not observed | Cex. |
| 23 | 1 | 5.7 | 11.0 | 1.9 | 55 | observed | Cex. |
| 24 | 1 | 5.4 | 13.0 | 2.0 | 71 | observed | Cex. |
| 25 | 2 | 6.9 | 21.0 | 2.5 | <5 | not observed | Ex. |
| 26 | 3 | 7.0 | 20.0 | 2.5 | <5 | not observed | Ex. |
| 27 | 4 | 6.5 | 23.0 | 2.75 | <5 | observed | Cex. |
| 28 | 5 | 6.4 | 21.0 | 2.45 | <5 | not observed | Ex. |
| 29 | 6 | 7.9 | 11.0 | 1.9 | <5 | not observed | Cex. |
| 30 | 7 | 6.6 | 21.0 | 2.5 | <5 | observed | Cex. |
| 31 | 8 | 7.7 | 18.0 | 2.4 | <5 | not observed | Ex. |
| 32 | 9 | 7.9 | 11.0 | 1.9 | <5 | not observed | Cex. |
| 33 | 10 | 7.8 | 16.0 | 2.3 | <5 | not observed | Ex. |

*Ex. denotes Example of the invention.
Cex. denotes Comparative Example.
**Result of corrosion resistance testing in deteriorated gasoline containing 800 ppm of formic acid at 50° C. for 25 hours × 200 cycles (total 5,000 hours)

Example 2

Cold-rolled steel sheets 0.75 mm in thickness prepared by processing steel No. 1 in Table 1 according to the conditions of No. 2 in Tables 2 and 3 in EXAMPLE 1 were washed with an alkaline solution, and various amounts of lubricant coat containing an acrylic resin as the primary component, percent by volume of calcium stearate, and 5 percent by volume of polyethylene wax were applied to these steel sheets. Each sheet was baked at 80° C.±5° C. for 15 seconds. The weldability and sliding performance of the prepared test pieces were examined. The results are shown in Table 5.

In the sliding performance testing, a test piece 300 mm in length and 10 mm in width was placed between flat dies with a contact area with the test piece of 200 $mm^2$ under an area pressure of 8 $kgf/mm^2$ and a dynamic friction coefficient (μ) was determined by a pulling-out force (F). The spot weldability was evaluated based on a nugget diameter of a welded portion generated by welding two sample pieces each approximately 0.8 mm in thickness using a chromium-copper alloy 16 mm in diameter and an R type electrode 40 mm in radium at a current of 5 kA under a pressure of 2 KN. A nugget diameter of $3\sqrt{t}$ or less was evaluated as welding failure (B in Table 5) and a nugget diameter exceeding $3\sqrt{t}$ was evaluated as exhibiting satisfactory weldability (A in Table 5).

The results demonstrate that application of at least 0.5 $g/m^2$ of lubricant coat is required to improve the sliding performance. At a coating amount exceeding 4.0 $g/m^2$, the improvement in sliding performance is saturated and the weldability is impaired as a result of poor electrical conductivity during spot welding.

TABLE 5

| Coating amount ($g/m^2$) | Sliding test (Dynamic friction coefficient: μ) | Weldability (Nugget diameter) |
|---|---|---|
| 0.08 | 0.420 | A |
| 0.16 | 0.298 | A |
| 0.35 | 0.189 | A |
| 0.52 | 0.105 | A |
| 0.96 | 0.102 | A |
| 1.44 | 0.097 | A |
| 2.09 | 0.099 | A |
| 2.77 | 0.095 | A |
| 3.90 | 0.095 | A |
| 4.52 | 0.096 | B |
| 5.0 | 0.097 | B |

A > $3\sqrt{t}$,
B ≦ $3\sqrt{t}$
(t: sheet thickness)

As described above, the invention can provide a ferritic stainless steel sheet having an r-value of at least 2.0 exhibiting excellent deep drawability and surface smoothness. The steel sheet of the invention can be applied to home electric appliances, kitchen appliances, constructions, and automobile components which have been conventionally made with austenitic stainless steels.

The ferritic stainless steel sheet of the invention is also excellent in corrosion resistance to organic fuels containing organic acids and can thus be applied to fuel tanks and fuel pipes for automobile gasoline and methanol.

What is claimed is:

1. A method for making a ferritic stainless steel sheet, the method comprising the steps of:

preparing a steel slab containing not more than about 0.1% C, not more than about 1.0% Si, not more than about 1.5% Mn, not more than about 0.06% P, not more than about 0.03% S, about 11% to about 23% Cr, not more than about 2.0% Ni, about 0.5% to about 3.0% Mo, not more than about 1.0% Al, not more than about 0.04% N, at least one of not more than about 0.8% Nb and not more than about 1.0% Ti, and the balance being iron (Fe) and unavoidable impurities, satisfying relationship (1):

$$18 \leqq Nb/(C+N)+2Ti/(C+N) \leqq 60 \quad (1)$$

where C, N, Nb, and Ti in relationship (1) represent the C, N, Nb, and Ti contents by mass percent, respectively;

heating the steel slab at a temperature in the range of about 1,000° C. to about 1,200° C.;

hot-rough-rolling the steel slab at a rolling temperature of at least one pass of about 850° C. to about 1,100° C. by a reduction of about 35%/pass or more;

hot-finish-rolling the slab at a rolling temperature of at least one pass of about 650° C. to about 900° C. by a reduction of about 20 to about 40%/pass to prepare a hot-rolled sheet;

annealing the hot-rolled sheet at a temperature in the range of about 800° C. to about 1,100° C.;

cold-rolling the resulting annealed sheet at least twice with intermediate annealing therebetween, said cold rolling being performed at a gross reduction of about 75% or more and a reduction ratio (reduction in the first cold rolling)/(reduction in the final cold rolling) in the range of about 0.7 to about 1.3; and finish annealing the cold-rolled sheet at a temperature in the range of about 850° C. to about 1,050° C.

2. The method for making the ferritic stainless steel sheet according to claim 1, wherein the Cr and Mo contents in the steel slab satisfy the relationship (2):

$$Cr+3.3Mo \geqq 18 \quad (2)$$

wherein Cr and Mo in relationship (2) represent Cr and Mo contents by mass percent, respectively.

3. The method for making the ferritic stainless steel sheet according to claim 1, wherein the grain size number of ferrite crystal grains of the steel sheet before the final cold rolling measured according to JIS G 0552 is not less than about 6.5.

4. The method for making the ferritic stainless steel sheet according to claim 2, wherein the grain size number of ferrite crystal grains of the steel sheet before the final cold rolling measured according to JIS G 0552 is not less than about 6.5.

5. The method for making the ferritic stainless steel sheet according to claim 1, wherein said step of cold rolling is performed in a single direction using a tandem rolling mill comprising a work roller having a diameter of about 300 mm or more.

6. The method for making the ferritic stainless steel sheet according to claim 2, wherein said step of cold rolling is performed in a single direction using a tandem rolling mill comprising a work roller having a diameter of about 300 mm or more.

7. The method for making the ferritic stainless steel sheet according to claim 3, wherein said step of cold rolling is performed in a single direction using a tandem rolling mill comprising a work roller having a diameter of about 300 mm or more.

8. The method for making the ferritic stainless steel sheet according to claim 4, wherein said step of cold rolling is performed in a single direction using a tandem rolling mill comprising a work roller having a diameter of about 300 mm or more.

9. The method for making the ferritic stainless steel sheet according to claim 5, wherein said step of cold rolling is performed in a single direction using a tandem rolling mill comprising a work roller having a diameter of about 300 mm or more.

10. The method for making the ferritic stainless steel sheet according to claim 1, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

11. The method for making the ferritic stainless steel sheet according to claim 2, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

12. The method for making the ferritic stainless steel sheet according to claim 3, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

13. The method for making the ferritic stainless steel sheet according to claim 4, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

14. The method for making the ferritic stainless steel sheet according to claim 5, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

15. The method for making the ferritic stainless steel sheet according to claim 6, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

16. The method for making the ferritic stainless steel sheet according to claim 5, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

17. The method for making the ferritic stainless steel sheet according to claim 8, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

18. The method for making the ferritic stainless steel sheet according to claim 9, further comprising the step of bake-coating the finish-annealed ferritic stainless steel sheet with a lubricant coat comprising an acrylic resin, calcium stearate, and polyethylene wax in a coating amount of about 0.5 to about 4.0 g/m$^2$.

* * * * *